US008029272B1

(12) United States Patent
Kunkle

(10) Patent No.: US 8,029,272 B1
(45) Date of Patent: Oct. 4, 2011

(54) SELF-ACTIVATED CANDLE EXTINGUISHING DEVICE

(76) Inventor: Randall L. Kunkle, Amherst, NY (US)

( * ) Notice: Subject to any disclaimer, the term of this patent is extended or adjusted under 35 U.S.C. 154(b) by 469 days.

(21) Appl. No.: 12/335,971

(22) Filed: Dec. 16, 2008

Related U.S. Application Data

(60) Provisional application No. 61/063,613, filed on Feb. 5, 2008.

(51) Int. Cl.
*F23Q 25/00* (2006.01)
*F21V 35/00* (2006.01)

(52) U.S. Cl. ..... 431/35; 33/34; 33/149; 33/152; 33/289; 33/291

(58) Field of Classification Search ..... 431/35, 431/33, 289, 291, 149, 152, 34
See application file for complete search history.

(56) References Cited

U.S. PATENT DOCUMENTS 879,934 A * 2/1908 Williams ..... 431/34
1,101,296 A * 6/1914 Liaci ..... 431/35
1,517,115 A * 11/1924 Handler ..... 431/35
2,185,364 A * 1/1940 Andrews ..... 236/102
2,741,904 A * 4/1956 Stelle et al. ..... 431/146
4,138,211 A 2/1979 Kampfer
5,601,272 A * 2/1997 Adams et al. ..... 248/518
5,944,505 A 8/1999 Kroecher
6,572,365 B1 6/2003 Byxbe

FOREIGN PATENT DOCUMENTS

DE 19548365 * 7/1997

* cited by examiner

*Primary Examiner* — Steven B McAllister
*Assistant Examiner* — Avinash Savani
(74) *Attorney, Agent, or Firm* — Vincent G. LoTempio; Douglas Smith; Brendan Lillis

(57) ABSTRACT

This invention relates to a self-activated automatic candle snuffer. The device generally comprises a back plate connected to a base and to a spoon having a hole so that the back plate supports the spoon for spring movement with respect to the base. A candle mounted to the base so that the candle passes through the hole in the spoon. A set pin movably affixed to the spoon proximate the hole, operatively arranged to pierce and enter the candle so as to maintain tension in the spoon. A ball balanced on the spoon and a means for release of tension in the spoon which causes release of potential energy that allows the spoon to elevate to an inclined plane to cause the ball to roll down the spoon to settle on the hole and the wick and extinguish a flame.

18 Claims, 4 Drawing Sheets

SELF-ACTIVATED CANDLE EXTINGUISHING DEVICE

This application claims priority of U.S. Provisional Patent Application of Randall L. Kunkle, Ser. No. 61/063,613 for SELF-ACTIVATED CANDLE EXTINGUISHING DEVICE, filed on Feb. 5, 2008.

BACKGROUND OF THE INVENTION

1. Field of the Invention

This invention relates to candle extinguishing device. More particularly, the invention relates to an non-electric self activated automatic candle extinguishing device which allows a candle to burn for a predetermined amount of time before being snuffed out.

2. Background

Several devices have been invented to automatically extinguish a candle. For example U.S. Pat. No. 4,138,211 issued to Kampfer et al, discloses a thermomechanical candle snuffer utilizing metals with mechanical memory properties. Mechanical memory metals can be deformed into bent shapes which recover their unbent state upon heating above the metals recovery temperature. In this invention, as a candle burns down, it will heat the metal and cause it to return to its unbent state. Utilizing this phenomenon, the invention comprises a clip for securing a snuffing cone to a candle. The length of metal between the clip and the cone is made of the thermomechanical metal with the cone being held away from the burning candle. With recovery of the metal to its unbent state, the snuffing cone is brought over the burning wick causing the flame to be extinguished. This design depends on the clip holding the snuffing cone in the desired position for proper functioning. Thus, the clip must apply sufficient force to the candle so that the clip and snuffer do not slide down the length of the candle negating the desired automatic extinguishing of the flame. The problem with this configuration is that if the clip applies too much force, the candle may be crushed or even broken. Therefore, each candle diameter requires its own clip to function properly. Additionally, another problem is that the melting wax may interfere with the thermomechanical metal causing the metal's recovery to fail or be hindered.

U.S. Pat. No. 5,944,505 issued to Kroecher describes a candle snuffing device having two candles attached at opposite ends of a pivoting balancing arm. Above each candle is a snuffing cone for extinguishing the candle. One candle is lit at a time, and as the wax melts, the burning candle reduces its mass. The counterbalance of the opposite, non-burning candle pivots the balancing arm causing the burning candle to rise toward the snuffing cone. Once enough wax is consumed the candle reaches the snuffing cone and is extinguished automatically. This design, however, requires careful balancing of the arm to function properly. Although the candle is extinguished automatically, there is uncertainty in the burning time of the lit candle due to various sizes and densities of candles. Depending on the candle's burn rate and the mass of the counterbalance, the burning of the candle may be too long or too short for the user's desired timeframe. Also, this design limits the types of candles that can be used—namely tealight or votive, and not tapered, candles.

Byxbe discloses an automatic candle snuffer in U.S. Pat. No. 6,572,365. This device places a candle within a sealed container having an automated closeable lid. The lid is held open with a magnetized hinge mechanism. A user inputs a predetermined time into a timer which is partially attached to the container and partially attached to the lid. When this time is reached, the timer demagnetizes the hinge allowing the lid to close the container. As the oxygen in the container is consumed by the flame, the candle is automatically extinguished. This design suffers various drawbacks, including obstruction of the candle and difficulty in lighting the candle. By placing a box around the candle, the candle and/or candle flame is obstructed by the box, limiting the types of materials which can be used to construct the box. Depending on the height of the box and height of the candle, it may be onerous or even dangerous to try to light the candle using a match or cigarette lighter because a user has to reach into the box to set the wick alight. This reaching may cause the user to be burned by either the match or the candle once lit. Alternatively, the user may light the candle and then place the box over the lit candle. However, if the box does not sit correctly, air will leak into the box and provide sufficient oxygen for the candle to continue burning after the selected extinguishing time. Manipulating the box to ensure a good seal could lead to the lit candle tipping over and becoming extinguished, or increase risk of burning the user or setting something external from the device on fire.

Thus it is readily apparent that there is a need for an automatic candle extinguisher capable of snuffing a candle after a predetermined amount of time. There is a particular need for a candle extinguisher that is decorative and interesting to watch.

SUMMARY OF THE INVENTION

It is accordingly a primary object of the present invention to provide a self-activated candle snuffer to automatically extinguish a flame.

Another object of the invention is to provide a self-activated candle snuffer utilizing a heat resistant ball to extinguish a flame.

Yet another object of the invention is to provide a self-activated candle snuffer with that is safe and reliable.

A further object of the invention is to provide a self-activated candle snuffer that is easy to manufacture and use.

Another further object of the present invention is to provide a self-activated candle snuffer for that is unique and aesthetically appealing.

The above and other objects are accomplished in accordance with the present invention which comprises a self-activated candle extinguishing device comprising: a back plate connected to a base and to a spoon having a hole so that the back plate supports the spoon for spring movement with respect to the base. A candle mounted to the base so that the candle passes through the hole in the spoon. A set pin movably affixed to the spoon proximate the hole, operatively arranged to pierce and enter the candle so as to maintain tension in the spoon. A ball balanced on the spoon and a means for release of tension in the spoon which causes release of potential energy that allows the spoon to elevate to an inclined plane to cause the ball to roll down the spoon to settle on the hole and the wick. The candle extinguishing device of the present invention is suitable for automatically snuffing a candle after a predetermined burning time. In operation, a user places a candle in the candle holder on the base and places the flexible spoon in the desired slot on the back plate of the frame. The free end of the spoon is flexed slightly downward and is held in place with a set screw set into the wax candle. A heat resistant ball is placed on the free end of the spoon and the candle is lit. Once the candle burns down to a point where the wax is melted or sufficiently softened to allow the set pin to move through the wax, the tension on the spoon is removed. This allows the spoon's free end to rise, in turn causing the heat resistant ball to roll onto the candle wick and extinguish the candle.

BRIEF DESCRIPTION OF THE DRAWINGS

The present invention and the manner in which it may be practiced is further illustrated with reference to the accompanying drawings wherein.

DETAILED DESCRIPTION OF THE INVENTION

Figure 1:
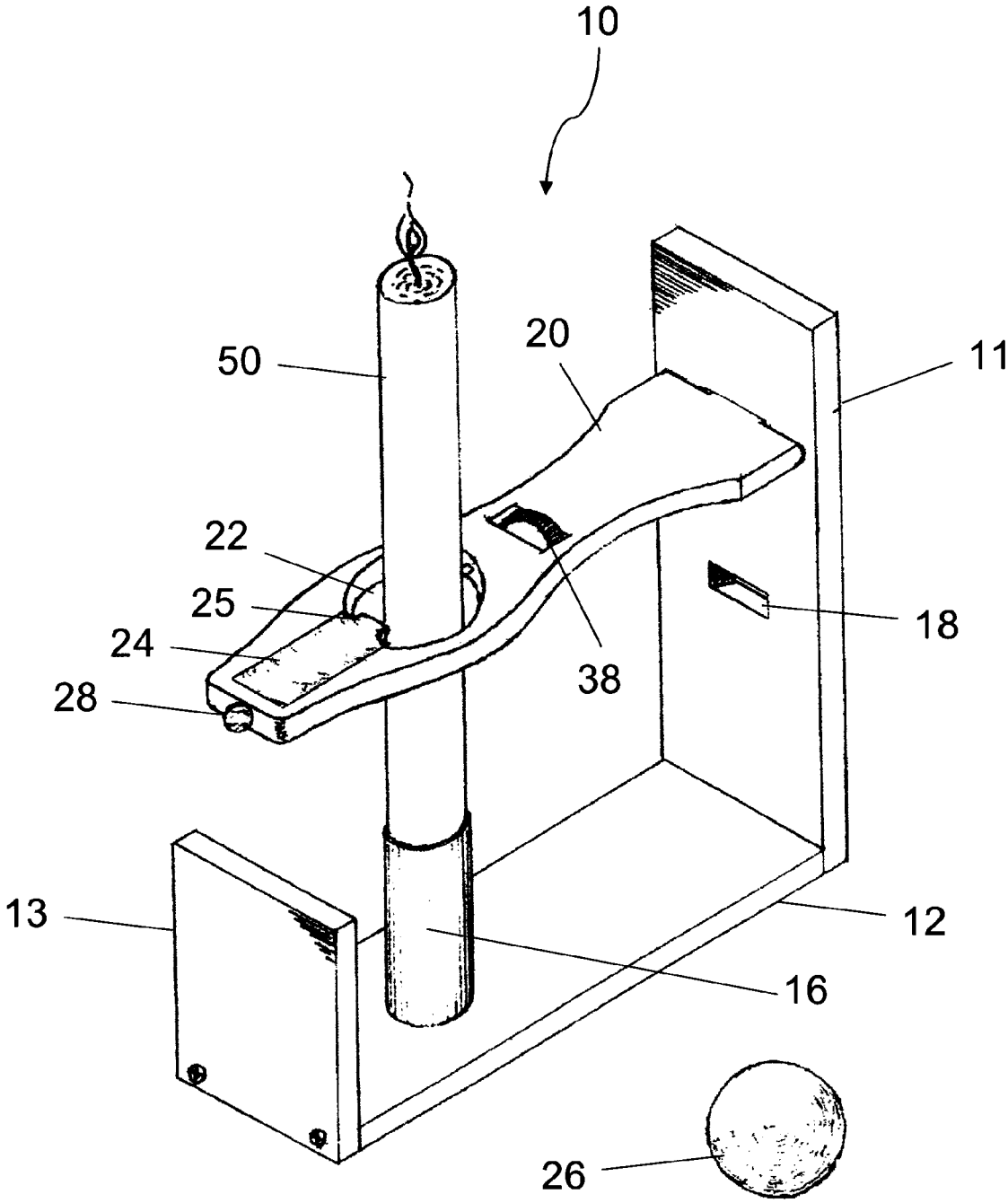
FIG. 1 is a perspective view of an embodiment of the present invention.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Figure 2:
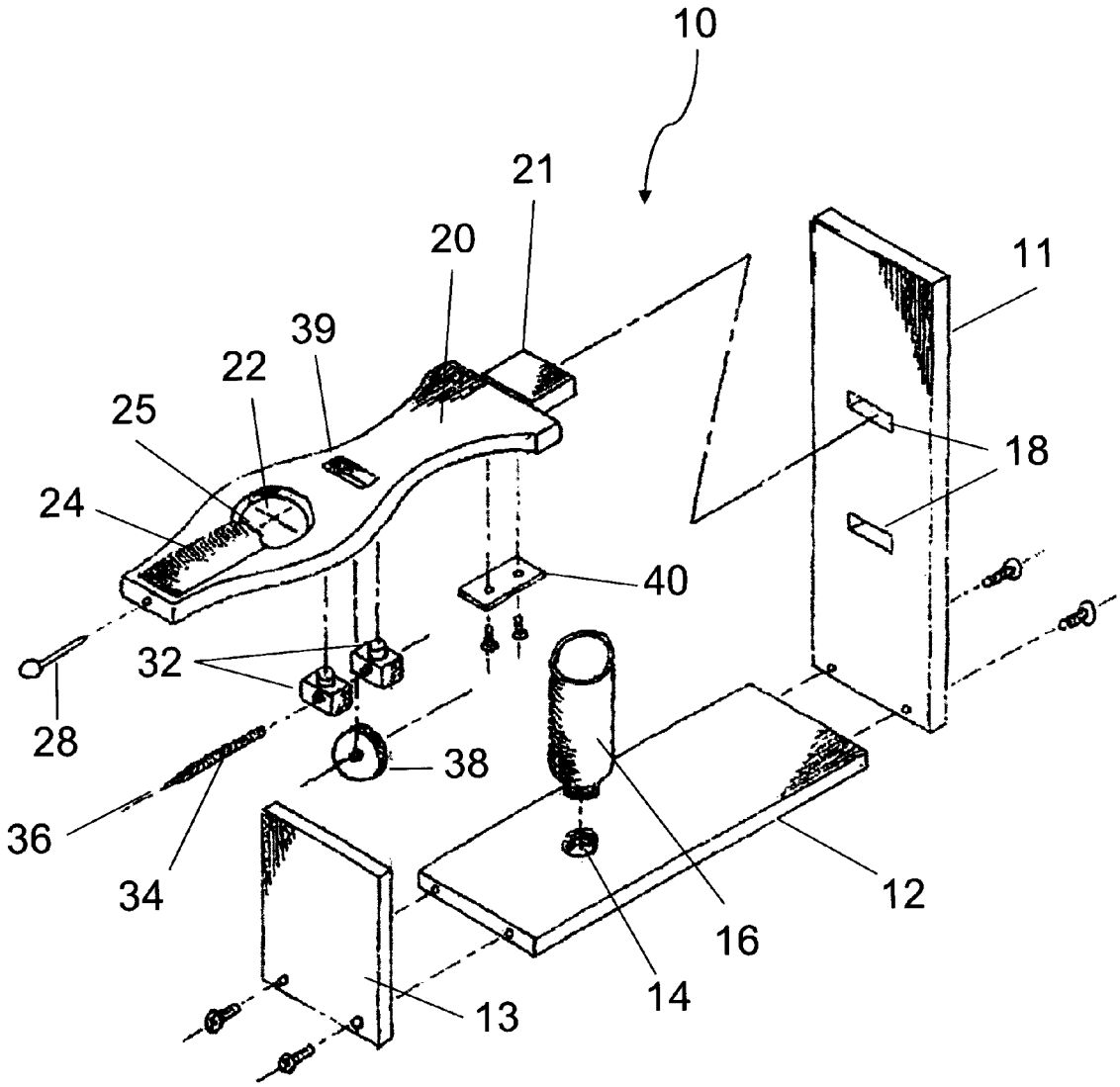
FIG. 2 is an exploded view of an embodiment of the present invention.
Figure 3:
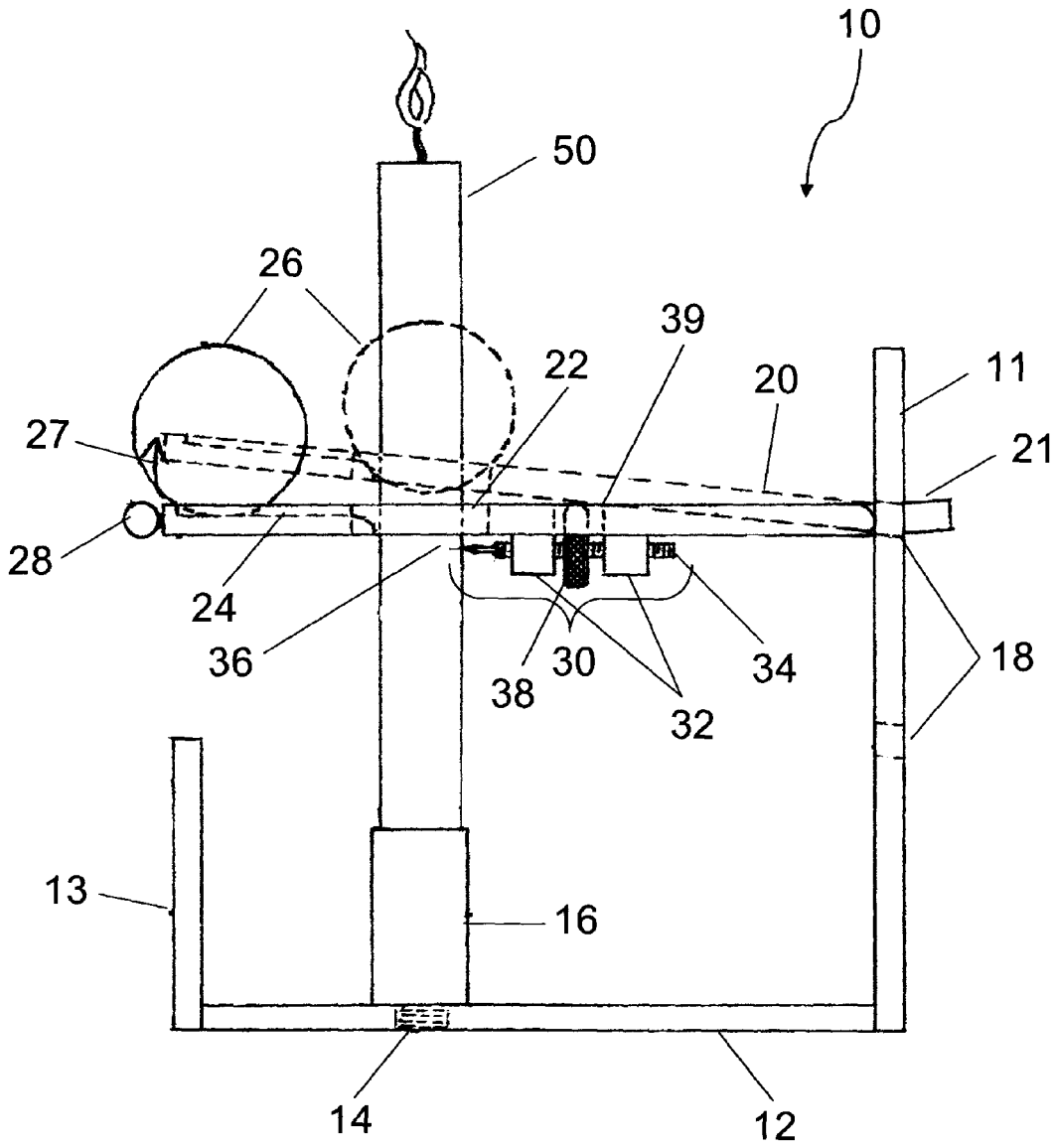
FIG. 3 is a side perspective view of an embodiment of the present invention showing the spoon under tension white candle is burning (solid lines) and without tension when candle is extinguished by the ball (dashed lines).

Adverting now to the drawings, with reference to FIGS. 1 through 3, a preferred embodiment of the present invention is indicated generally by numeral 10. Frame 10 is generally U-shaped having a spoon 20 attached to a back plate 11, a base plate 12, and optionally decorative front plate 13. The back plate and front plate are disposed in a parallel spaced-apart relationship to one another and are each rigidly connected to base plate 12. Although the generally U-shaped frame of the preferred embodiment, as shown in the drawings, is constructed from separate components, (spoon 20, back plate 11, base plate 12, and front plate 13) it should be understood that other constructions may be used without departing from the invention. For example, spoon 20, back plate 11, base plate 12, and front plate 13 may be formed in a unitary construction as a single molded unit. In this preferred embodiment the frame 10 is comprised of a light metal, however it should be readily understood that generally U-shaped frame 10 can be comprised of any heat resistant material with sufficient durability and hardness to maintain its structural integrity under the extreme heat of the flame of a candle.

Figures 4A, 4B:
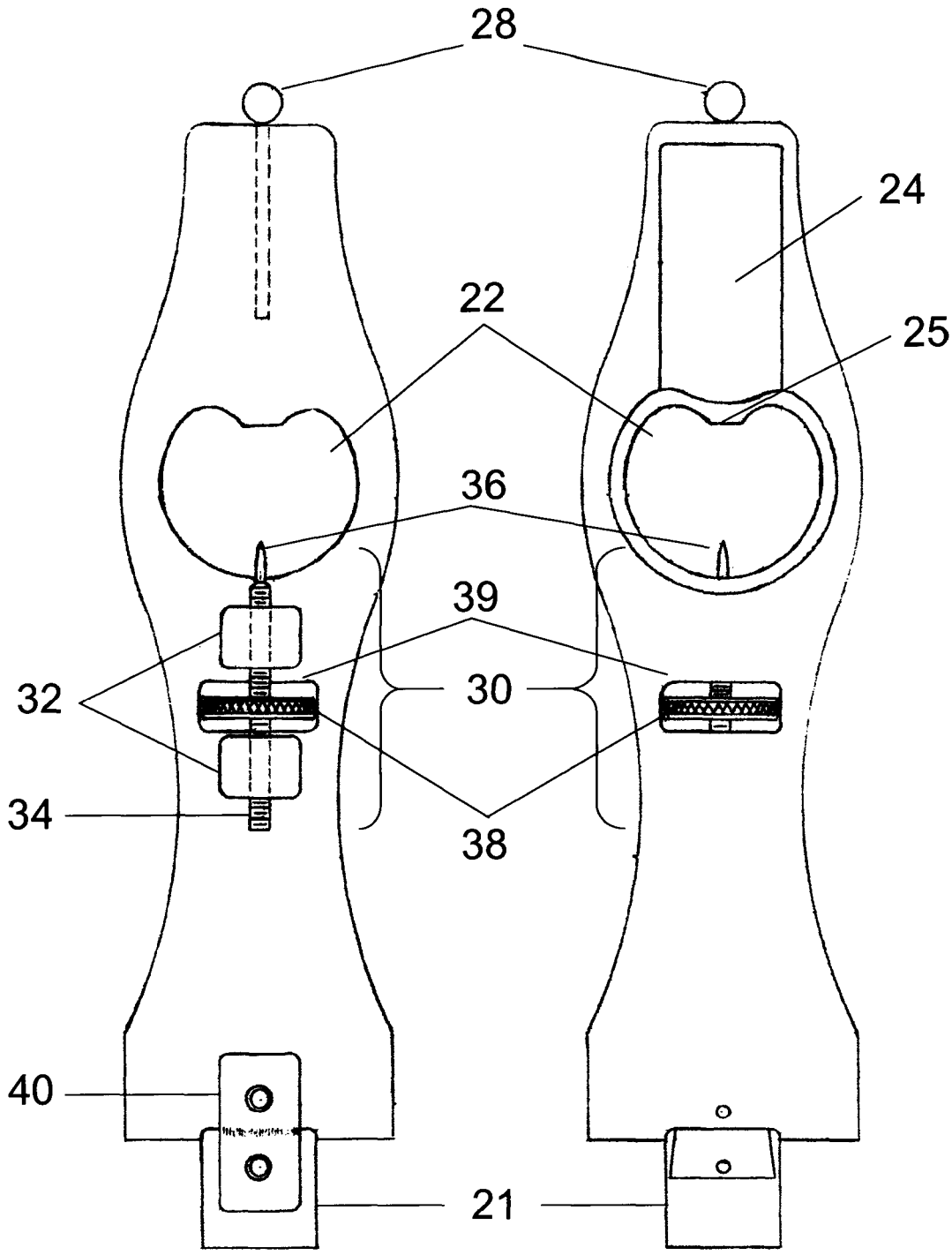
FIG. 4*a* is an underside perspective view of the spoon of the present invention.
FIG. 4*b* is a top perspective view of the spoon of the present invention.

Face plate 13 may be omitted to yield a generally U-shaped frame consisting of spoon 20, back plate 11 and base plate 12. The base plate includes a threaded hole 14 to receive candle base 16. Candle base 16 is a vessel that snuggly holds candle 50 upright and has a threaded bottom portion used to rigidly affix the candle base to the base plate. The candle base can be of any height or circumference provided that the candle fitted within the vessel is able to pass through the opening in the spoon, as discussed further below. Alternatively, the candle base may have a threaded bottom hole while the base plate contains a non-threaded hole. In a preferred embodiment, the candle base is rigidly affixed to the base plate using a countersunk lag screw. The back plate contains a plurality of slots 18 in which, at any one time, a single slot accommodates spoon 20. The spoon has a tenon 21 which fits within slot 18 such that the spoon extends roughly perpendicularly from back plate 11 and faces front plate 13. Slots 18 are provided so that based upon the position of the spoon the user can regulate the amount of time in which the candle will burn. The position of each slot is selected based upon the size of the candle and the amount of time the user selects the candle to burn. Two slots 18 are shown, but any plurality of slots can be placed within back plate 11. Spoon 20 has an opening 22 positioned to correspond with candle base 16 such that a candle 50 will pass through the spoon when placed within the candle base. Set pin assembly 30, shown in greater detail in FIGS. 4*a* and 4*b*, is positioned on the underside of the spoon between the spoon tenon 21 and opening 22. The set screw mechanism is adjusted using a thumb wheel 38 which protrudes through an opening 39 in the spoon. The set screw 34 is this connected to set pin 36 and is the mechanism to adjust the position and insert set pin 36 into candle 50. The top side of the spoon, opposite the tenon, contains a grooved track 24 leading to opening 22. Track 24 holds heat resistant ball 26 and allows the ball to roll into opening 22 to extinguish the candle flame. Track 24 may have a protrusion 25 into opening 22, but not to an extent to interfere with the passing of candle 50 through the opening. Ball 26 is made of any heat resistant material including but not limited to any metal, metal allow, glass, or ceramic and has a circumference greater than the smallest diameter of opening 22. In a preferred embodiment, spoon 20 contains a wick lifter 28 removeably inserted into a hole positioned opposite the spoon tenon. Wick lifter 28 is a short, pin-like strip of metal with a decorative cap that can be easily removed from spoon 20 and used as a tool to dislodge a wick from a burned-out candle. Ideally, the design of the decorative cap will match the design of heat resistant ball 26.

Spoon 20 is preferably made of solid cast aluminum or other similar metal that is light and sturdy however it can be constructed of any heat resistant material. Preferably, this material will be a metal or metal alloy, such as but not limited to copper, aluminum, steel, or brass. In the preferred embodiment of this invention, back plate 11 is a rigid structure that holds spoon 20 and tension is engaged by the use of tensioning spring 40. However it should be appreciated that spoon 20 can be shaped to make it spring when tension is released from the set pin, for example, spoon 20 can be configured based upon its dimensions to be a flexible material, for example, if at the connection point the spoon was thinner than the rest of the body of the spoon it would be flexible at this point without the use of a spring 40. In another preferred embodiment, generally U-shaped frame of this invention is a unitary assembly that is flexible throughout and where tension can be stored in a plurality of positions throughout the base and back plate. For example, the present invention could be comprised of one continuous coil strip of metal such as brass or aluminum.

FIG. 3 illustrates the mechanism of a preferred embodiment of the invention. The solid lines depict the perpendicular to the base position of spoon 20 under tension held by set pin assembly 30 while the candle is burning. The dashed lines depict the inclined plane of the spoon once the candle has burned down and the set pin has relieved the stored tension allowing spoon 20 to spring upwards and remain in an inclined plane. The spring-like motion raises the ball end of the spoon allowing ball 26 to roll down track 24 and extinguish the flame. In an alternative embodiment, tensioning spring 40 (shown in FIGS. 2 and 4*a*) is used to attach tenon 21 to spoon 20 and function as a hinge in conjunction with back plate 11. This hinge will allow the ball to roll down the track as the set pin releases the tension by sliding through the soft melted wax once the candle burns down to the position of the pin. As shown by arrow 27, the spoon inclines upward allowing the ball to roll down the track into the opening in the spoon extinguishing the flame. It should be appreciated that, although FIG. 3 depicts tenon 21 extending beyond hole 18 of back plate 11, tenon 21 can be shortened such that it does not extend through hole 18, allowing this embodiment to be wall-mountable.

FIG. 4*a* shows the underside of the spoon while FIG. 4*b* shows the top view of the spoon. Both figures depict spoon tenon 21, candle opening 22, optional wick lifter 28 and tension spring 40 which functions as a hinge in one preferred embodiment. FIG. 4*a* provides a more detailed view of set pin assembly 30. Mounting brackets 32 hold set screw 34 to the underside of the spoon and are threaded to provide longitudinal adjustability of set pin 36 as thumb wheel 38 which passes through the spoon via hole 39 is turned by the user. Set pin 36 is controllably inserted into the candle to retain tension on the spoon without inoperably damaging the candle. In a preferred embodiment, for convenience and accurate alignment, set pin 36 of the present invention is generally adjusted using a thumb wheel 38 which protrudes through an opening in the spoon 20. Set pin 36 is controllably inserted into the candle and is configured to lock the spoon in position. As will be appreciated, when the pointed end of the set pin is inserted into the wax shaft of the candle a consistent tension point of alignment is maintained until the pin is released by the flame of the candle from the melted wax. Once the pin releases the tension on the spoon it elevates and the ball rolls to the top of the candle to extinguish the flame. In a preferred embodiment the set pin is controlled by turning thumb wheel 38 to move the pin into the candle but it can be controlled by some other means such as a dial, manually inserting the pin into the candle, a lever or cam, a simple pushpin or screw and even a clamp for example.

FIG. 4*b* depicts the top view of the spoon showing the orientation of ball track 24 with hole 22, thumb wheel 38 and the spoon tenon 21. Ball track 24 is a channel that directs the ball to hole 22 when the spoon is elevated to an inclined plane.

Although the invention has been described with reference to certain preferred embodiments, it will be appreciated by those skilled in the art that modifications and variations may be made without departing from the spirit and scope of the invention. It should be understood that applicant does not intend to be limited to the particular details described above and illustrated in the accompanying drawings. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A device for candle snuffing comprising:

(a) a back plate connected at one end to a base the base having a candle support;

(b) a ramp connected at one end to a front face of said back plate, said ramp having a hole near an opposite end, wherein the ramp is resiliently biased with respect to the back plate such that the opposite end of the ramp is located above the one end absent a retaining force;

(c) a candle having a wick, which is mounted to said base at one end so that the other end of the candle passes through said hole in said ramp;

(d) a set pin movably affixed to said ramp proximate said hole, operatively arranged to pierce and enter said candle so as to provide said retaining force in said ramp;

(e) a ball balanced on said opposite end of said ramp;

(f) a means for release of tension in said ramp which causes a release of potential energy that allows said ramp to elevate to an inclined plane to cause the ball to roll along said ramp to settle on said hole and said wick.

2. The device for candle snuffing of claim 1 wherein said ramp has a grooved track to direct said ball to said hole.

3. The device for candle snuffing of claim 1 wherein lateral movement of said set pin is manually adjusted with a thumb wheel.

4. The device for candle snuffing of claim 1 further comprising a removable wick lifter housed within said spoon.

5. The device for candle snuffing of claim 1 wherein said means for release of retaining force is burning of said wick to melt said candle and release said set pin from said candle.

6. The device for candle snuffing of claim 1 wherein said spoon is removably attached to said back plate and said back plate has a plurality of slots located along its length configured to accept said spoon.

7. The device for candle snuffing of claim 1 wherein said spoon is attached to said back plate with a spring.

8. The device for candle snuffing of claim 1 wherein said spoon is attached to said back plate with a tenon.

9. A device for candle snuffing comprising:

(a) a generally U-shaped frame having a base plate for supporting a candle and a back plate, a ramp perpendicularly affixed to said back plate the ramp having a hole;

(b) a candle having a wick mounted at one end to said base of U-shaped frame so that the other end of the candle passes through said hole of the ramp said U-shaped frame;

(c) a set pin movably affixed to said ramp of U-shaped frame positioned to enter said candle proximate said hole and hold the ramp in place;

(d) a ball positioned on said generally U-shaped frame on one end of the ramp;

(e) a means for elevating the ramp of said U-shaped frame to an inclined plane to cause the ball to roll down the ramp of said U-shaped frame to settle on said hole and said wick when said candle burns to a predetermined level.

10. The device for candle snuffing of claim 9 wherein said generally U-shaped frame is a comprised of a flexible coil of a copper sheet metal.

11. The device for candle snuffing of claim 9 wherein said means for elevation is a release of tension held within said flexible coil of a copper sheet metal.

12. The candle snuffing device of claim 9 wherein movement of said set pin is manually adjusted through the use of a thumb wheel.

13. The device for candle snuffing of claim 7 wherein said means for release of tension is burning said wick to melt said candle and release said set pin from said candle.

14. The device for candle snuffing of claim 7 wherein said generally U-shaped frame has a grooved track to direct said ball to said hole.

15. A method for snuffing a candle comprising the following steps:

(a) providing a device for candle snuffing having a back plate a first one end to a base providing a ramp affixed to a front face of the back plate, wherein at least one end of the ramp has a hole, wherein the ramp is resiliently biased with respect to the back plate such that the opposite end of the ramp is located above the affixed point, absent a retaining force; a wax candle having a wick, which is mounted to said base at one end so that the other end of the candle passes through said hole in said ramp;

a set pin movably affixed to said ramp positioned to enter said candle proximate said hole; a ball positioned on the distal end of said ramp relative to said back plate wherein said candle is interposed between said ball and said back plate;

(b) applying downwardly flexing tension on said distal end of said ramp;

(c) inserting said set pin into said candle to maintain downwardly flexing tension on said ramp;

(d) combusting said wax until said wax reaches a point where said set pin releases the downwardly flexing tension on said ramp causing said distal end of said ramp to upwardly incline relative to the base causing said ball to roll down said inclining ramp to settle on said wick extinguishing combustion of said candle.

16. The method for snuffing a candle of claim 15 wherein the rolling of said ball is within a grooved track on said ramp.

17. The method for snuffing a candle of claim 15 wherein said set pin is manually adjusted through the use of a thumb wheel.

18. The method for snuffing a candle of claim 15 wherein said spoon further comprises a removable wick lifter housed within said ramp.

* * * * *